United States Patent [19]

Dadbeh

[11] Patent Number: 5,067,728

[45] Date of Patent: Nov. 26, 1991

[54] LAWN DART WITH SAFETY FEATURE

[75] Inventor: Bemanali H. Dadbeh, Seal Beach, Calif.

[73] Assignee: Harvard Sports, Inc., Compton, Calif.

[21] Appl. No.: 237,538

[22] Filed: Aug. 29, 1988

Related U.S. Application Data

[63] Continuation of Ser. No. 148,042, Jan. 25, 1988, abandoned.

[51] Int. Cl.[5] ..... A63B 65/02

[52] U.S. Cl. ..... 273/420; 273/398

[58] Field of Search ..... 273/398, 420, 1.5 R, 273/417, 408

[56] References Cited

U.S. PATENT DOCUMENTS

| | | | |
|---|---|---|---|
| 1,424,674 | 8/1922 | Orr | 273/420 |
| 2,770,460 | 11/1956 | Deasy | 273/398 |
| 3,181,269 | 5/1965 | Nixon | 273/420 X |
| 3,181,849 | 5/1965 | Mitchell | 273/1.5 X |
| 3,784,199 | 1/1974 | Chmela | 273/420 |
| 3,982,762 | 9/1976 | Milicic | 273/420 |
| 4,262,909 | 4/1981 | Becker et al. | 273/417 X |

FOREIGN PATENT DOCUMENTS

| | | | |
|---|---|---|---|
| 22630 | 1/1962 | German Democratic Rep. | 273/420 |
| 1527631 | 10/1978 | United Kingdom | 273/408 |

*Primary Examiner*—Paul E. Shapiro

*Attorney, Agent, or Firm*—Irving Keschner

[57] ABSTRACT

A lawn dart having front and rear portions, the front portion comprising a cylindrically shaped, hollow member fabricated from a flexible material, such as plastic. An elongated flexible tip in first, second and third embodiments is formed as a part of the hollow member, and in a fourth embodiment, is a second component coupled to the hollow member, the flexible tip absorbing and dissipating the energy of impact. A material to provide weight stability to the dart is positioned in the hollow portion of the cylindrical member. In the preferred embodiments, air cushions within the hollow portion act with the flexible tip to enhance the absorption and dissipation of the impact energy. The rear portion of the dart is in the preferred embodiments, permanently secured to the front portion.

A target member, comprising a closed ended member, having netting attached thereto, is anchored to the ground and supported thereabove by a plurality of anchor members.

The dart is aimed at the target, and if aimed correctly, the dart will be caught within the netting in an upright position.

4 Claims, 3 Drawing Sheets

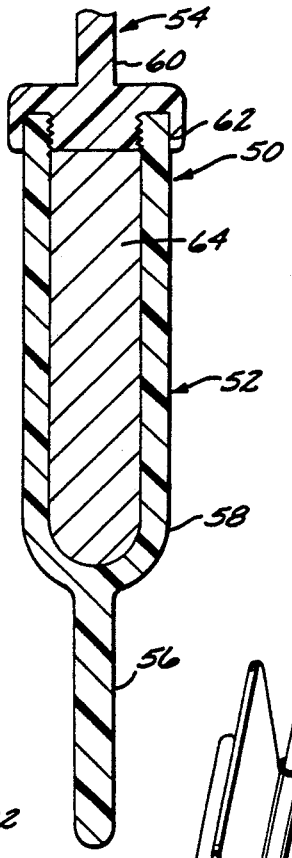
FIG. 6
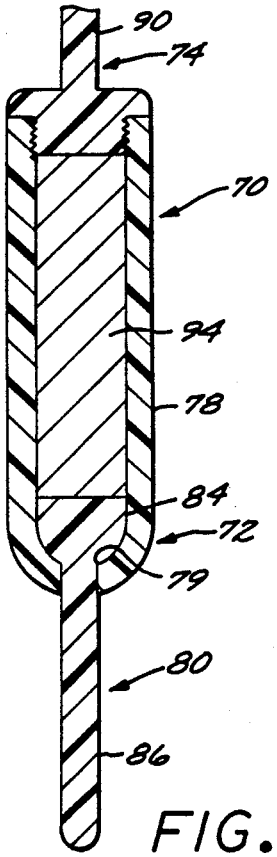
FIG. 11
FIG. 14
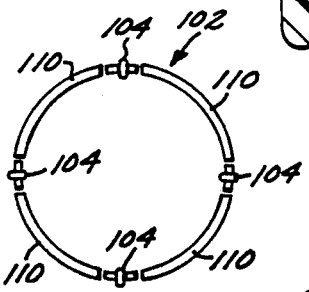
FIG. 13
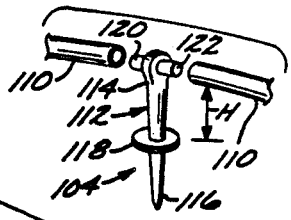
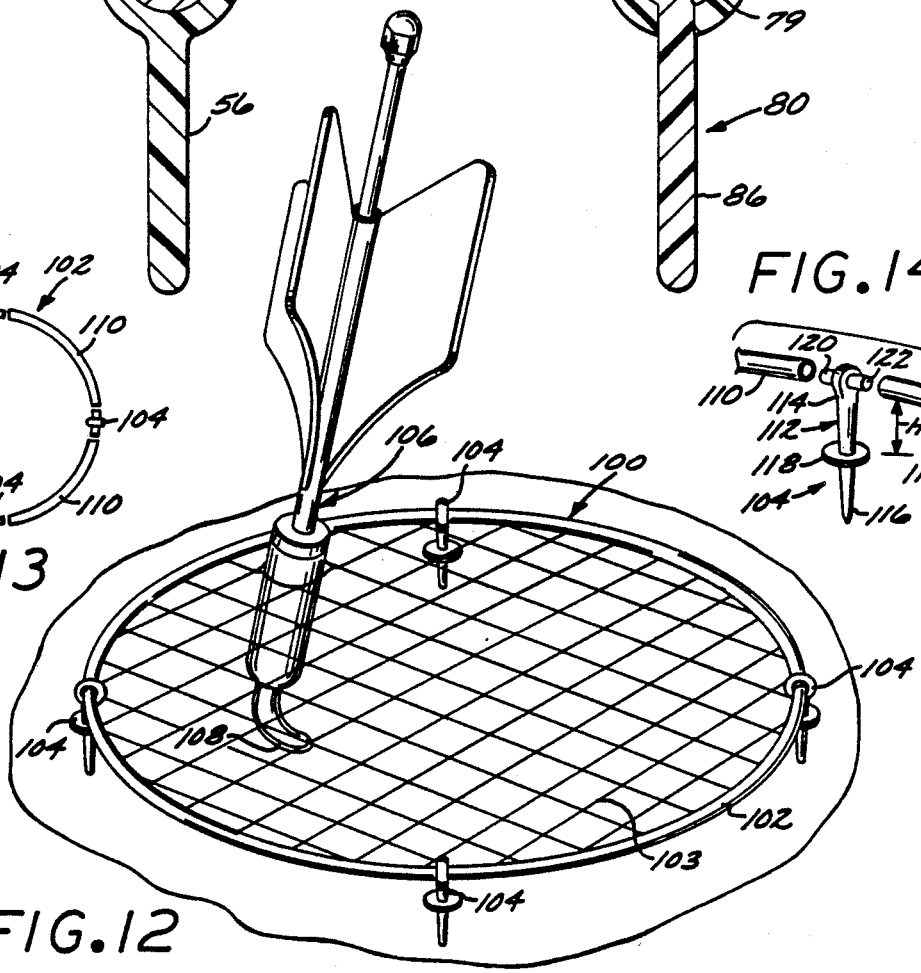
FIG. 12

FIG. 7
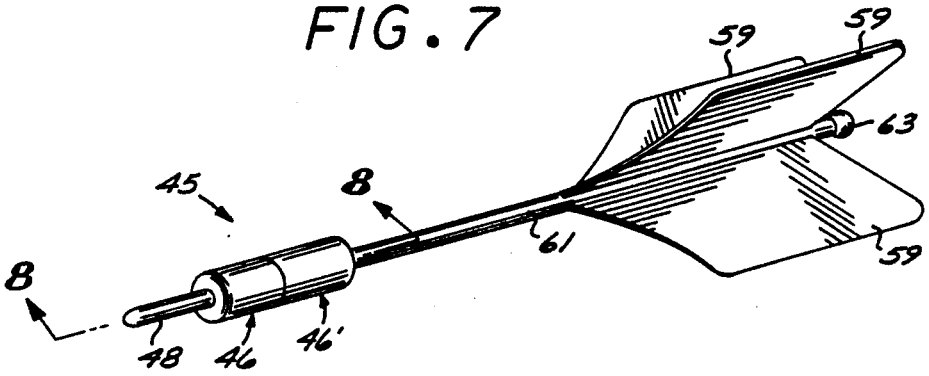
FIG. 8
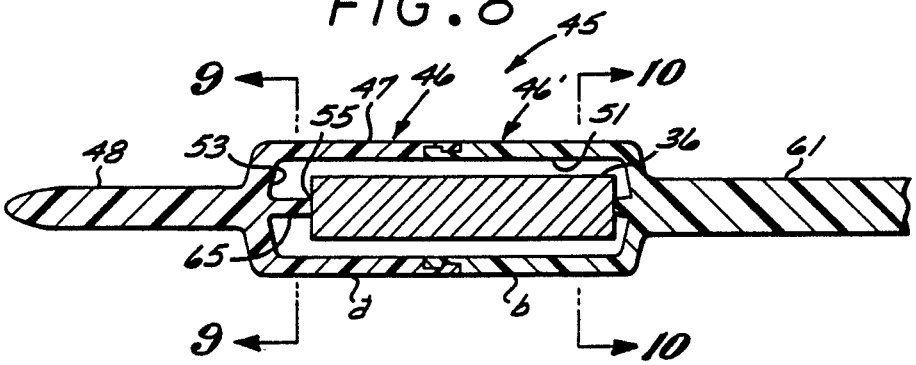
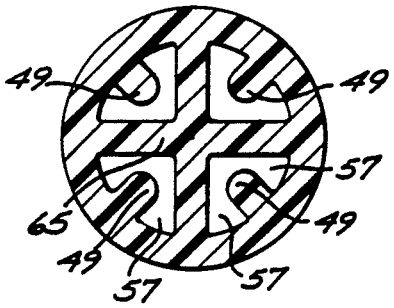
FIG. 9
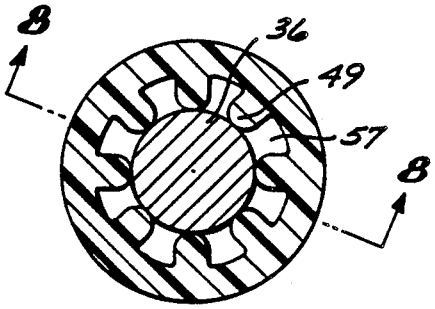
FIG. 10

LAWN DART WITH SAFETY FEATURE

CROSS-REFERENCE TO RELATED APPLICATION

This application is a continuing application of application Ser. No. 148,042 filed Jan. 25, 1988, now abandoned.

BACKGROUND OF INVENTION

1. Field of the Invention

The present invention relates to lawn darts, and in particular, to a safety lawn dart.

2. Description of the Related Art

Lawn dart games have been commercially available for many years. These games typically comprise a dart having an elongated metal tip designed to penetrate the ground and a rear portion having extended fins to control the stability of the dart during flight. The games include a target area which typically comprises a closed ended member positioned some distance away from the dart user.

Unfortunately, a number of injuries have occurred recently as a result of inadvertently thrown darts, typically darts thrown by unsupervised children. In one such incident, a child was killed by a dart which penetrated her head. As a result of this and other accidents, efforts are being made to severely restrict (or totally ban) lawn dart games. On the other hand, the public demand for these games has not significantly decreased, notwithstanding the adverse publicity regarding their use.

What is therefore desired is a lawn dart game which overcomes the aforementioned disadvantages, particularly body penetration, which is safe and relatively inexpensive to manufacture.

SUMMARY OF THE INVENTION

The present invention provides a lawn dart having front and rear portions, the front portion comprising a cylindrically shaped, hollow member fabricated from a flexible material, such as plastic. A flexible elongated tip is, in the first, second and third embodiments, formed as a part of the hollow member, and in the fourth embodiment, is a separate component attached to the hollow member, the flexible tip absorbing and dissipating the energy of impact. A material to provide weight stability to the dart is positioned within the hollow portion of the cylindrical member. In the preferred embodiments, air cushions within the hollow portion act with the flexible tip to enhance the absorption and dissipation of the impact energy. The rear portion of the dart in the preferred embodiments is fixedly secured to the front portion, thus preventing the safety dart from being disassembled and then reassembled into a dart configuration which is unsafe.

A target member, comprising a closed ended member having a netting attached thereto, is anchored to the ground and supported thereabove by a plurality of anchor members.

The dart is aimed at the target, and if aimed correctly, the dart will be caught within the netting in an upright position. If the dart misses the target and strikes the ground, the flexibility of the tip prevents the dart from penetrating the ground. Similarly, if the dart inadvertently strikes a person, the flexible nature of the tip and the air cushion prevents the dart from penetrating the person's body, at least to the extent of causing any serious injury when compared to current lawn darts by absorbing the impact and dissipating the energy.

The present invention thus satisfies both potential users of lawn dart games and the manufacturer/retailer thereof at the same time i.e. a desired consumer product which has been redesigned to meet safety concerns.

BRIEF DESCRIPTION OF THE DRAWING

For a better understanding of the invention, as well as other objects and further features thereof, reference is made to the following description which is to be read in conjunction with the accompanying drawing wherein:

FIG. 6 is a cross-sectional view illustrating the interior of the lawn dart in accordance with a second embodiment of the invention;

FIG. 7 is a perspective view of a safety lawn dart fabricated in accordance with the teachings of a third embodiment of the present invention;

FIG. 8 is a partial cross-sectional view along line 8—8 of FIG. 7;

FIG. 9 is a sectional view along line 9—9 of FIG. 8;

FIG. 10 is a cross-sectional view along line 10—10 of FIG. 8;

FIG. 11 is a cross-sectional view illustrating the interior of the lawn dart in accordance with a fourth embodiment of the present invention;

FIG. 12 illustrates the lawn dart receiver device in accordance with the teachings of the present invention;

FIG. 13 is a view of the tubular segments which comprise the lawn dart receiver; and FIG. 14 is a more detailed view of the anchor members used to secure the lawn dart receiver.

DESCRIPTION OF THE PREFERRED EMBODIMENTS

Figure 1:
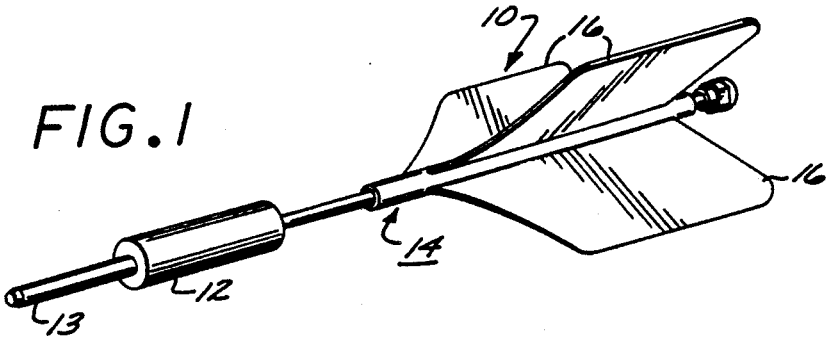
FIG. 1 is a perspective view of a prior art lawn dart.

Referring now to FIG. 1, a perspective view of a conventional prior art lawn dart 10 is illustrated. In essence, lawn dart 10 comprises a cylindrically shaped, weighted front metal portion 12, having a metal tip 13 and an elongated rear portion 14. Rear portion 14 has a plurality of fin-like members 16 radially extending from rear portion 14 and acts to provide stability to the dart during flight. Obviously, if dart 10 is misthrown and strikes a person instead of a game target, the tip 13 is capable of penetrating the person's body.

Referring now to FIGS. 2–5, views of a novel lawn dart 20 constructed in accordance with a first embodiment of the present invention is illustrated. Lawn dart 20 comprises a front portion 22 and a rear portion 24. Front portion 22 comprises a cylindrically shaped, hollow flexible air cushion shell 26, comprising parts 27 and 29, and a flexible, soft tip 28, shell 26 and tip 28 being preferably made of "soft" plastic, such as flexible poly proplene, or rubber. Rear portion 24 comprises an elongated shaft member 30, a cap member 32, and a plurality of fins 34 extending radially from shaft member 30. Flexible tip 28 is molded as part of shell 26.

Figure 2:
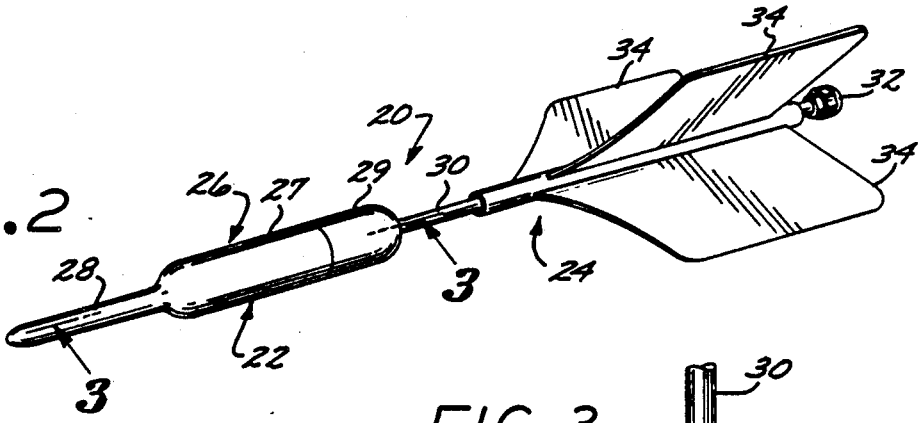
FIG. 2 is a perspective view of a safety lawn dart fabricated in accordance with the teachings of a first embodiment of the present invention.
Figure 3:
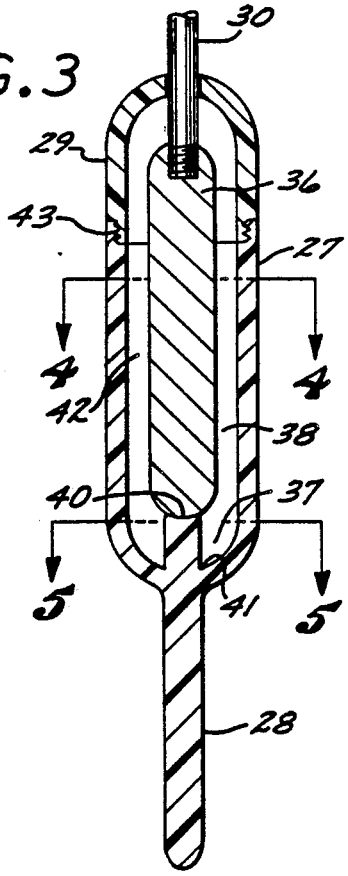
FIG. 3 is a cross-sectional view along line 3—3 of FIG. 2.
Figure 4:
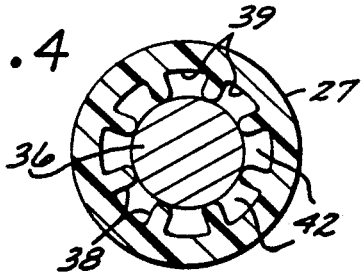
FIG. 4 is a cross-sectional view along line 4—4 of FIG. 3.
Figure 5:
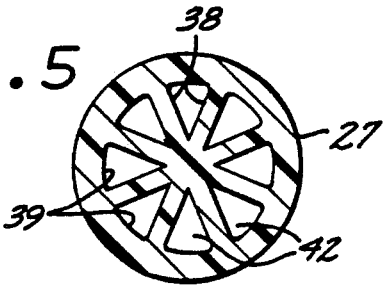
FIG. 5 is a cross-sectional view along line 5—5 of FIG. 3.

FIG. 3 is a cross-sectional view along line 3—3 of FIG. 2 and shows a weighting member 36 positioned within shell 26 and secured to one end of shaft member 30, as illustrated, to provide weight stability to the dart. In the preferred embodiment, member 36 comprises a cylindrically shaped, solid metal member fabricated of steel. A plurality of rib-like members 38 are formed on the interior surface 39 of shell 26 (shown more clearly in the cross-sectional view of FIG. 4) in order to center member 36 within shell 26. The rib members 38 extend further inwardly from surface 39 at end point 40 of member 36 (as shown in FIG. 5) to position member 36 above the lower surface of shell 36 a predetermined amount to provide a large air cushion area 37 to absorb the shock of impact. The passages 42 formed by adjacent ribs 38 provide additional air cushion areas to absorb impact shock (although referred to as two separate air cushion areas, area 37 and the areas formed by adjacent ribs 38 actually form a single, connected air cushion, the former having a larger area adjacent the tip 28 than any of the air cushion passages). Thus, if the dart inadvertently or by misuse strikes a person, animal, etc., the air cushions within the shell 26 and the flexible tip act to absorb the impact and dissipate the energy of impact. An interlocking tongue and groove arrangement 43 prevents parts 27 and 29 from separating and exposing the member 36, thus preventing the dart from being utilized without its protective shell.

Referring now to FIG. 6, a cross-sectional view of a second embodiment of a novel lawn dart 50 in accordance with the teachings of the present invention is illustrated. The lawn dart 50 comprises a front portion 52, and a rear portion 54. Front portion 52 is made of a flexible material, such as plastic, and includes an elongated, tip member 56 and a hollow, cylindrically shaped portion 58. Rear portion 54, as described with reference to FIGS. 2–5, comprises an elongated shaft member 60, cap portion 62, and a plurality of fin-like members (not shown) extending radially therefrom to provide stability to the lawn dart when in flight. Front portion 52 is removably secured to rear portion 54 to allow the insertion/removal of material 64, which may comprise sand. Material 64 provides the necessary weight for stability when the lawn dart lands. The coupling between the front and rear portions of lawn dart 50 is such that it is "child-proof", a conventional securing technique which prevents children from removing the material 64 from portion 58 and eating the material or for the material to be lost. In this embodiment, an air cushion is not provided, the flexible tip 56 and the "soft" weighting material absorbing the impact and dissipating the energy of impact.

Referring now to FIGS. 7–10, a third embodiment of the lawn dart of the present invention is illustrated. The lawn dart 45 shown is similar to the lawn dart shown in FIGS. 2–5. In particular, lawn dart 45 has a front portion 46 comprising portion a of a cylindrically shaped, hollow member 47 and an elongated flexible tip 48 molded as part of portion a of member 47 and fabricated from a flexible plastic, such as poly propylene. A plurality of rib-like members 49 are formed on the interior surface 51 of member 45 in order to center weighting member 36 (identical to member 36 shown in FIGS. 2–5) within hollow member 47. A front rib member 65 extends further inwardly from surface 53 of member 47 to end point 55 thereby positioning member 36 a predetermined distance from surface 53 to provide a large air cushion area 47' to absorb the shock of impact. The passages 57 formed by adjacent ribs 49 provide additional air cushion areas to absorb impact shock (although referred to as two separate air cushion areas, area 47' and the areas formed by adjacent ribs 49 actually form a single, connected air cushion, the former having a larger area adjacent the tip 48 than any of the air cushion passages). Thus, if the dart inadvertently strikes a person, animal, etc., both the air cushions within member 47 and flexible tip 48 act to absorb the impact and dissipate the energy of impact. The rear portion 46' of dart 45 comprises the fin members 59, shaft 61, integral cap member 63 and portion b of the hollow shell member 47, all molded in one piece from a semi-flexible plastic material, such as poly propylene or polyethylene. A rear rib member 69, in conjunction with front rib member 65, supports member 36 within hollow member 47, thus maintaining member 36 in the position illustrated. The contacting ends of portions a and b are secured together using interlocking tongue and groove members.

In order to prevent the lawn dart 45 from being easily disassembled from its designed safety configuration and reassembled in a manner such that the reassembled configuration becomes unsafe, portions a and b of member 47 are cemented, fused, or bonded together to form a permanently assembled lawn dart configuration. A decorative band may be positioned about member 47 to cover the area where portions a and b are joined, the band also providing an additional technique for securing portions a and b together.

Referring now to FIG. 11, a cross-sectional view of a fourth embodiment of a novel lawn dart 70 in accordance with the teachings of the present invention is illustrated. As with the lawn darts described with reference to FIGS. 2–10, lawn dart 70 comprises a strike or front portion 72, and a rear portion 74. Front portion 72 is made of flexible material, such as plastic, and includes a hollow, cylindrically shaped portion 78, having an aperture 79 formed in front portion 72. An elongated member 80, comprising a head portion 84 and an elongated, cylindrical portion 86, and made of flexible material, such as plastic, is press-fit such that portion 86 passes through aperture 79 and head portion 84 is positioned within member 78 as illustrated. Rear portion 74 comprises an elongated shaft member 90, a plurality of fin-like members (not shown) extending radially therefrom to provide stability to the lawn dart when in flight. Front portion 72 is removably secured to rear portion 74 to allow insertion/removal of material 94, which may comprise, for example, a plurality of metal pellets or sand. As set forth with reference to the embodiment of FIG. 6, material 94 provides the necessary weight for stability when the lawn dart lands, and the coupling between the front and rear portions is such that it is "child-proof", a conventional securing technique which prevents children from removing the material 94 from portion 78 and eating the material or for the material to be lost.

Referring now to FIG. 12, a receiver or catch member 100 is provided to receive the thrown lawn dart. Receiver 100, which in essence is used as a target, comprises a closed ended member 102 and netting 103 secured thereto. A plurality of anchor members 104 (four illustrated and shown in more detail in FIG. 10) is used to secure the target to the ground at a predetermined height thereabove as illustrated. It should be noted that the anchor members can be adapted such that the hoop member is placed on and supported above other surfaces. A lawn dart 106 is shown as caught by receiver 100 in the upright position, with the tip 108 in its flexed, or bent, position caused by impact with surface 110. The size of the netting is selected to catch the dart at a point before the dart passes completely through the netting 103.

FIG. 13 illustrates one configuration of a close ended member 102. In particular, member 102 comprises four tubular segments 110 joined together by anchor members 104. FIG. 14 illustrates anchor member 104 in more detail. Member 104 comprises an elongated member 112 comprising a head portion 114 and a tip portion 116, portions 114 and 116 being separated by a disk shaped member 118. Tip portion 116 is used to penetrate the ground and securely hold receiver 100. Disk member 118 typically rests on the ground surface or grass and determines the height of the tubular segments 110 above the surface. Head portion 114 includes two pin members 120 and 122 which are press fit into the adjacent tubular segments 110.

Typically, the lawn dart during play is grasped at the rear portion and thrown, underhand, upwardly toward the target in a tossing manner. The combination of fins and weighting material causes the lawn dart to travel downward towards the target with the tip portion substantially in the vertical position at the time the lawn dart is caught by the netting 103 in receiver 100.

The present invention thus provides a lawn dart which includes features which substantially minimizes the risk that a stray dart could inadvertently penetrate an object, particularly a body part, and cause serious injury. The lawn dart, and the associated receiver, is relatively simple in design and inexpensive to manufacture.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A lawn dart comprising:

a first member having a flexible tip portion and a hollow portion; said hollow portion having a longitudinally extending axis;

a weight member fixedly positioned within said hollow portions;

a plurality of radially extending members formed on the inner surface of said hollow portion, the far ends thereof contacting said weight member within said hollow portion to form a plurality of air passages, the flexible tip and air passages acting to absorb and dissipate the energy of impact; and an elongated member coupled at one end to said first flexible member and having a plurality of fins extending radially from the other end.

2. The lawn dart of claim 1 wherein said weight member is coaxial along the longitudinal axis of said hollow portion.

3. The lawn dart of claim 1 further including a longitudinally extending member formed on the inner surface of said hollow portion and contacting one end of said weight member.

4. The lawn dart of claim 3, wherein said longitudinally extending member and a plurality of additional radially extending members formed on the inner surface of said hollow portion positions said weight member from the non-impact end of the tip portion and within said hollow portion in a manner whereby a plurality of additional air passages are formed within said hollow portion and adjacent the non-impact end of the tip portion, said air passages, additional air passages and said flexible tip acting to absorb and dissipate the energy of impact.

* * * * *